US011457687B2

(12) United States Patent
Kundani Kumta

(10) Patent No.: US 11,457,687 B2
(45) Date of Patent: Oct. 4, 2022

(54) SPRING LOCK MECHANISM FOR FOOTWEAR

(71) Applicant: Shailja Kundani Kumta, New York, NY (US)

(72) Inventor: Shailja Kundani Kumta, New York, NY (US)

( * ) Notice: Subject to any disclaimer, the term of this patent is extended or adjusted under 35 U.S.C. 154(b) by 0 days.

(21) Appl. No.: 17/443,486

(22) Filed: Jul. 27, 2021

(65) Prior Publication Data

US 2022/0022592 A1 Jan. 27, 2022

Related U.S. Application Data

(60) Provisional application No. 63/056,752, filed on Jul. 27, 2020.

(51) Int. Cl.
*A43B 3/24* (2006.01)

(52) U.S. Cl.
CPC ..... *A43B 3/244* (2013.01); *A43B 3/246* (2013.01)

(58) Field of Classification Search
CPC ..... A43B 3/244; A43B 3/246; A43B 3/24; A43B 3/122
USPC ..... 36/100, 101, 15
See application file for complete search history.

(56) References Cited

U.S. PATENT DOCUMENTS 4,172,330 A * 10/1979 Kao ..... A43B 3/103 36/11.5
4,450,633 A * 5/1984 Connelly ..... A43B 3/24 36/11.5
6,430,846 B1 * 8/2002 Lin ..... A43B 3/126 24/640
2003/0097722 A1 * 5/2003 Tsai ..... A43B 3/122 36/11.5
2005/0016019 A1 * 1/2005 Smith ..... A43C 11/00 36/7.7
2010/0088927 A1 * 4/2010 Spinelli ..... A43B 13/36 36/15
2013/0333246 A1 * 12/2013 Weller ..... A43B 3/26 36/103
2020/0359743 A1 * 11/2020 Bentvelzen ..... A43B 3/244
2022/0022592 A1 * 1/2022 Kundani Kumta .... A43B 3/242

OTHER PUBLICATIONS https://onesoleshoe.com/ Retrieved from Internet:Oct. 26, 2021.

(Continued)

*Primary Examiner* — Marie D Bays
(74) *Attorney, Agent, or Firm* — Danielle C. Sullivan; Theodore Y. McDonough; Carter Ledyard & Milburn LLP

(57) ABSTRACT

An article of footwear, including one or more interchangeable upper portions, the upper portion including loops on a bottom portion of the upper portion, a sole, the sole having engagement points around a perimeter of the sole, wherein the engagement points in the sole allow the loops to be inserted and/or removed; at least two spring lock systems, the spring lock systems located in the perimeter of the sole, wherein the spring lock systems include a spring, a flexible shaft, a lock and a spring plate, the lock and the spring plate being located in the engagement points, wherein the loops of the one or more upper portions to the sole engage with the lock and spring plate to secure and/or release the loops in position; and two or more sets of buttons on the sole to release or engage the spring lock system.

9 Claims, 7 Drawing Sheets

(56) References Cited

OTHER PUBLICATIONS https://www.alterreny.com/ Retrieved from Internet:Oct. 26, 2021.
https://www.commarts.com/exhibit/urshuz-shoe-design /Retrieved from Internet:Oct. 26, 2021.

* cited by examiner

SPRING LOCK MECHANISM FOR FOOTWEAR

This application claims priority to U.S. Provisional Patent Application No. 63/056,752, filed Jul. 27, 2020, entitled "SPRING LOCK MECHANISM FOR FOOTWEAR" and is hereby incorporated by reference herein.

FIELD OF THE INVENTION

The present invention relates to an improved apparatus and method for footwear, more particularly, an apparatus and method in which the upper portion of a piece of footwear attaches to the sole of the footwear and is held in place on the sole.

BACKGROUND OF THE INVENTION

Prior art includes products offered by One Sole, Alterre Shoes, and UrShuz. One Sole and Alterre both provide interchangeability of an upper portion of footwear; however, both are restricted in the range of styles available to a wearer. That restriction is a result of the manner and means by which the upper portion of the footwear attaches to the lower portion of the footwear and causes an inability to use a single sole to create both an open- and closed-style type of footwear. The product provided by UrShuz requires wearers to use a tool to manually assemble a wearable shoe. The wearer must use a tool to manually attach a number of "U-shaped" rings, which are attached to the upper part of the footwear, to the bottom portion of the sole of the footwear. This provides an inconvenient and cumbersome practice as well as an attachment that is insufficiently secure between the upper and lower portions of the footwear. Additionally, the attachment of the U-shaped rings on the bottom of the sole results in soiling of the rings at and around the point of attachment because of contact between the attachment point and the ground, and also results in unacceptable levels of wear at the point of attachment.

The present invention improves upon existing art in the field in several ways. One improvement includes providing a more secure connection between the upper portion and the sole of the footwear, thereby increasing the safety and durability of the footwear. The present invention is suitable for use in many styles and types of footwear, including open- and closed-style footwear, dress footwear, casual footwear, and boots. This provides a greater range of footwear styles from which a wearer may choose than are permitted by presently available technology and methods.

SUMMARY OF THE INVENTION

The present invention provides an improved design for footwear, and more particularly to an improved apparatus and method by which the upper portion of a piece of footwear attaches to the sole of the footwear and is held in place on the sole. The present invention allows a user to achieve multiple looks and styles for one pair of shoes using the same sole. The one shoe sole utilizes a mechanism for different uppers to be attached and removed so that multiple looks and styles can be achieved.

The present invention provides a mechanism that includes a spring lock system positioned around the perimeter of the sole. The mechanism of the present invention may be manually operated by use of buttons on the sole of the footwear, coupled with loops attached to the upper portion of the footwear with which the spring lock mechanism engages to lock together the upper and lower portions of footwear.

The present invention provides an article of footwear, including one or more interchangeable upper portions, the upper portion including loops on a bottom portion of the upper portion, a sole, the sole having engagement points around a perimeter of the sole, wherein the engagement points in the sole allow the loops to be inserted and/or removed; at least two spring lock systems, the spring lock systems located in the perimeter of the sole, wherein the spring lock systems include a spring, a flexible shaft, a lock and a spring plate, the lock and the spring plate being located in the engagement points, wherein the loops of the one or more upper portions to the sole engage with the lock and spring plate to secure and/or release the loops in position; and two or more sets of buttons on the sole to release or engage the spring lock system.

The present invention provides improvements upon existing art in the field in several ways. One improvement includes providing a more secure connection between the upper portion and the sole of the footwear, thereby increasing the safety and durability of the footwear. The present invention is suitable for use in many styles and types of footwear, including open- and closed-style footwear, dress footwear, casual footwear, and boots. This provides a greater range of footwear styles from which a wearer may choose than are permitted by presently available technology and methods.

BRIEF DESCRIPTION OF THE DRAWINGS

Further objects, features, and advantages of the invention will become apparent from the following detailed description taken in conjunction with the accompanying figures showing illustrative embodiments of the invention, in which.

DETAILED DESCRIPTION OF THE INVENTION

Figures 1A, 1B, 1C:
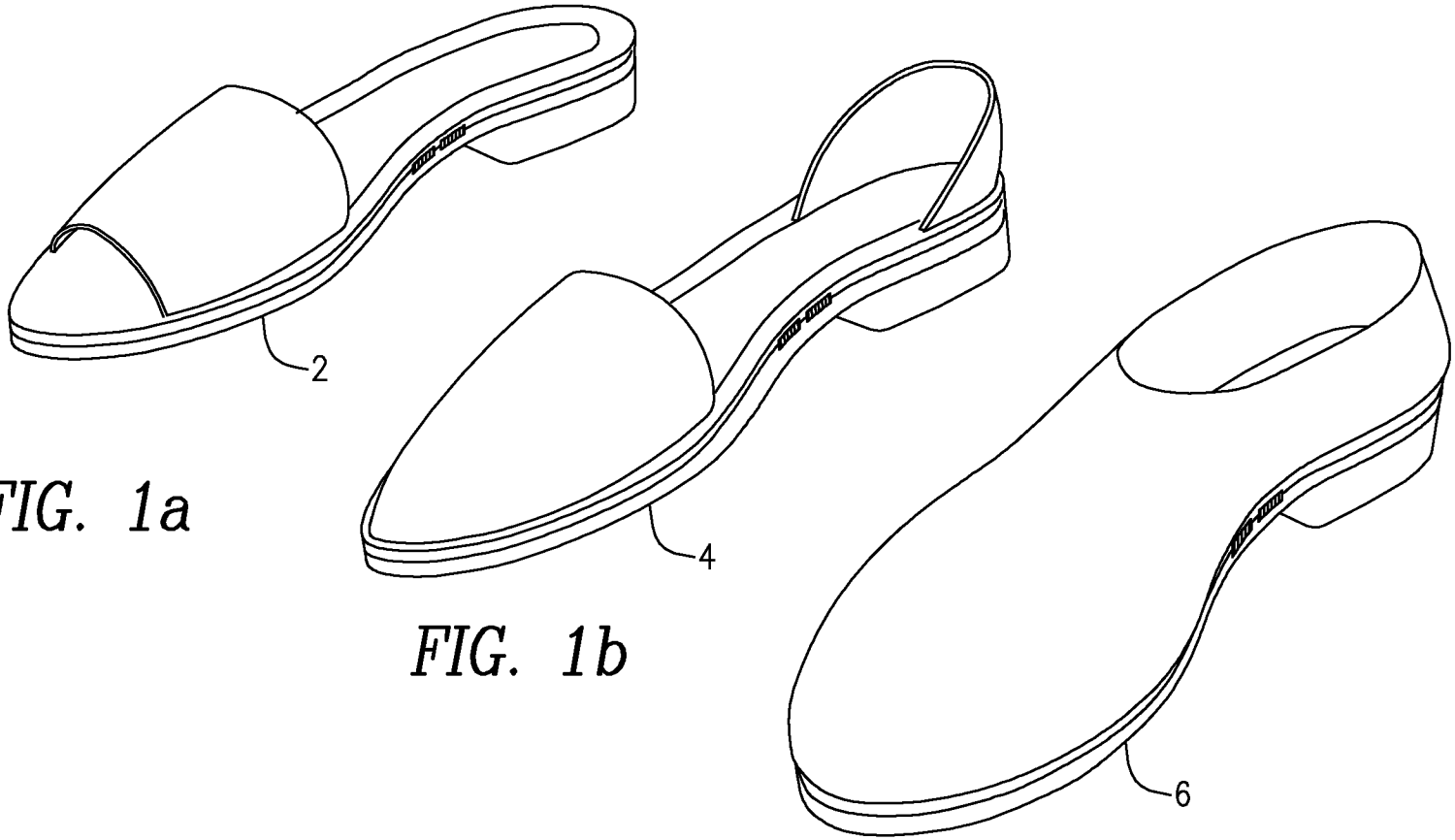
FIGS. 1*a*, 1*b*, and 1*c* show exemplary embodiments of some styles of the possible footwear options of the present invention.

The present invention provides a secure, temporary, and interchangeable attachment of an upper portion of a piece of footwear to the sole of the footwear, thereby allowing a wearer to create numerous styles of footwear, 2, 4, 6, using a single sole, as seen in FIGS. 1*a*, 1*b* and 1*c*.

Figures 2A, 2B, 2C:
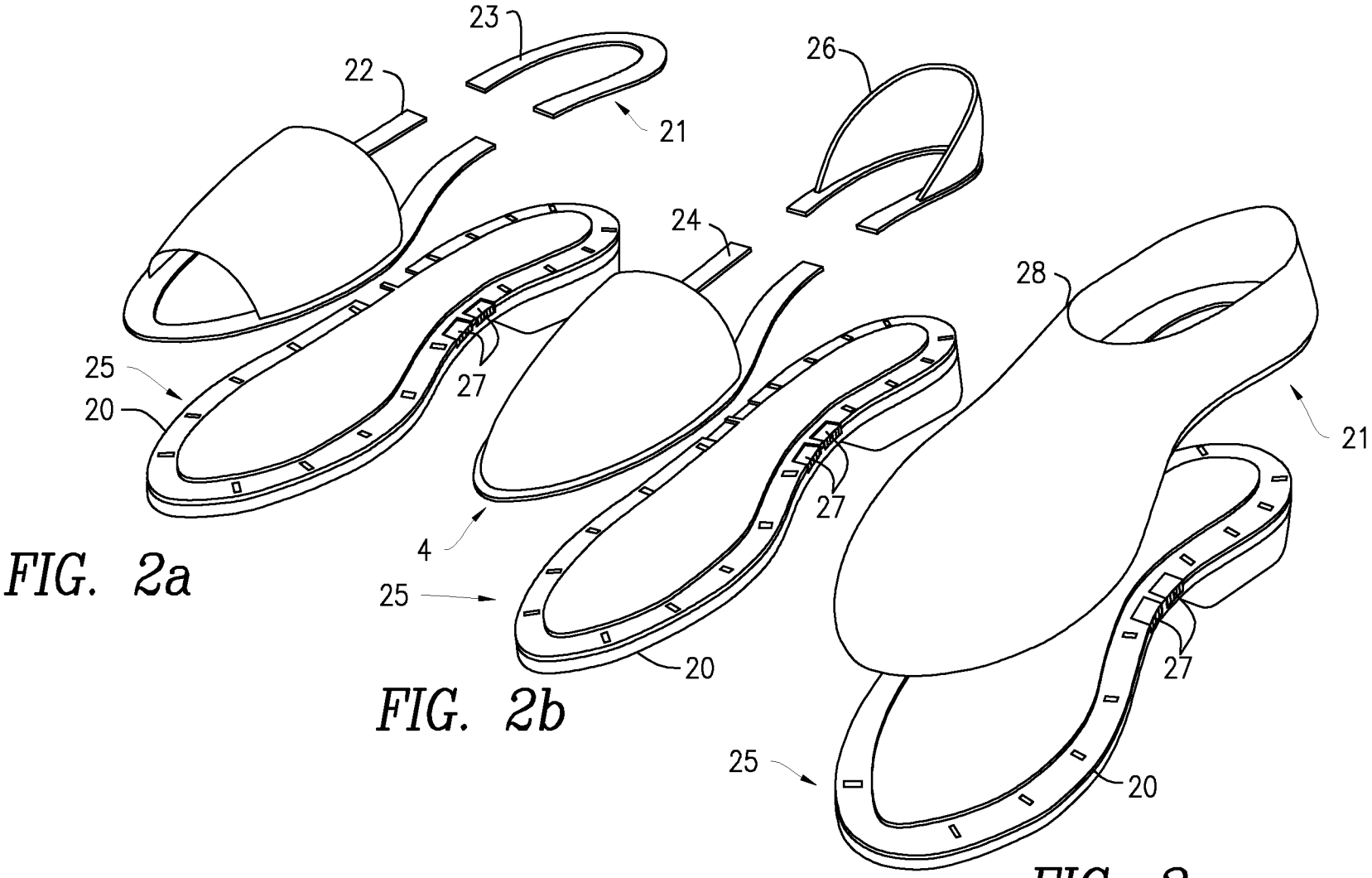
FIGS. 2*a*, 2*b*, and 2*c* show exemplary embodiments of the upper portions and the sole of the present invention.

FIGS. 2*a*, 2*b* and 2*c* show exemplary embodiments of the footwear whereby sole 20 of the footwear detaches and reattaches to various uppers, 22, 23, 24, 26, 28, using multiple spring lock mechanisms 25 that are located around sole 20. Bottom part 21 of the various upper attachments, 22, 23, 24, 26, 28, have loops that lock into sole 20 when the spring lock is locked. When the spring lock is released, upper portions 22, 23, 24, 26, 28, can be removed and a different one or more upper portions can be attached. The spring locks are controlled by two sets of buttons 27 located on both sides of sole 20.

Figure 3:
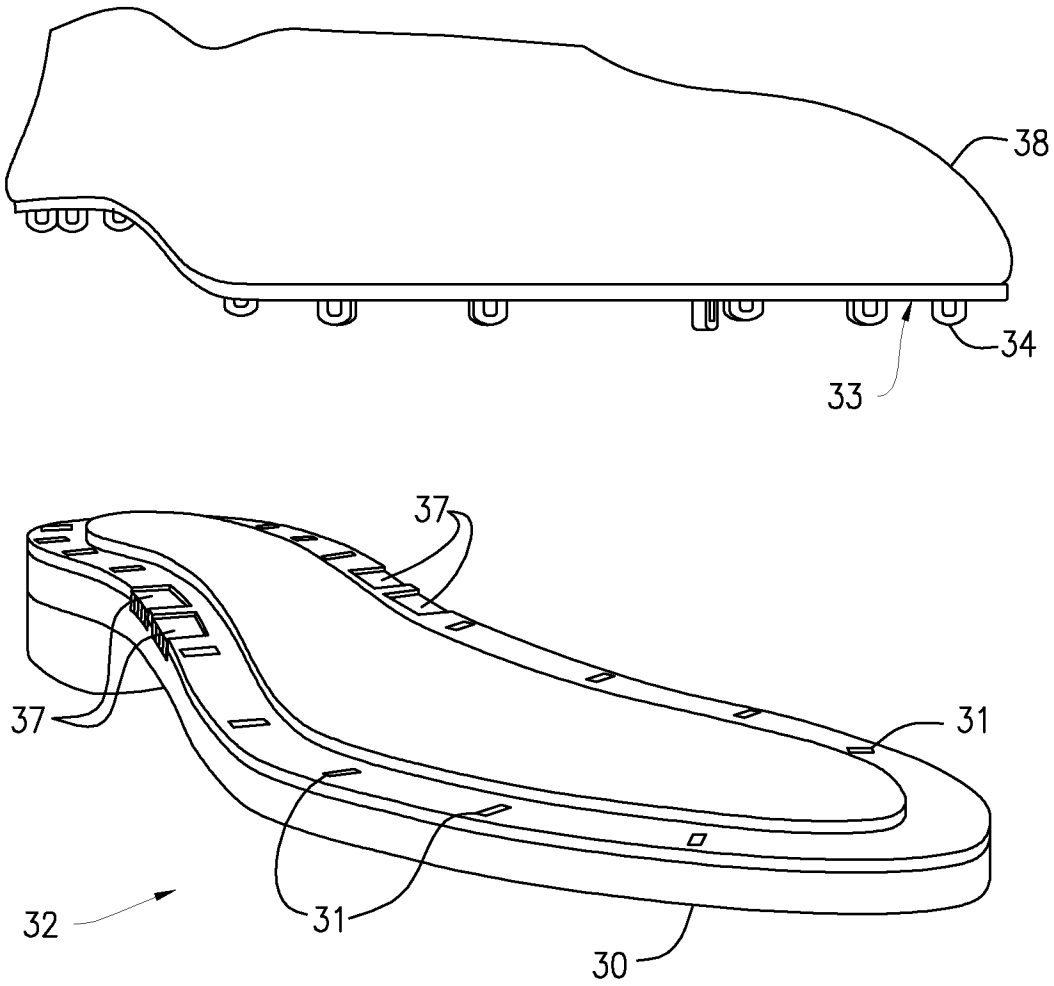
FIG. 3 shows an exemplary embodiment of the mechanisms of the loops in the upper portion and the engagements points in the sole where they will lock into place of the present invention.

FIG. 3 shows an exemplary embodiment of the mechanism of the present invention including spring lock system 32 positioned around the perimeter of sole 30. System 32 is manually operated by use of buttons 37 on sole 30 of the footwear, coupled with loops 34 attached to upper portion 38 of the footwear with which spring lock system 32 engages to lock together upper portion 38 and sole 30 of the footwear. Upper portion 38 of the footwear includes loops 34 on the bottom 33 perimeter of upper portion 38. Loops 34 may be made of metal, plastic, or another suitable rigid material. Loops 34 engage sole 30 of the footwear at engagement points 31 positioned around the perimeter of sole 30. Each engagement point 31 includes a lock and a spring plate. When buttons 37 in sole 30 are depressed, the locks at each engagement point 31 retract, releasing loops 34 and allowing upper portion 38 of the footwear to be removed and replaced with one or more different upper portions of the footwear. When buttons 37 on sole 30 are released, the locks in sole 30 engage with loops 34 and, in conjunction with the spring plate, cause upper portion 38 of the footwear to be securely fastened in place to sole 30. The many options for upper portions allow the wearer to choose and create varying styles of footwear.

Figure 4:
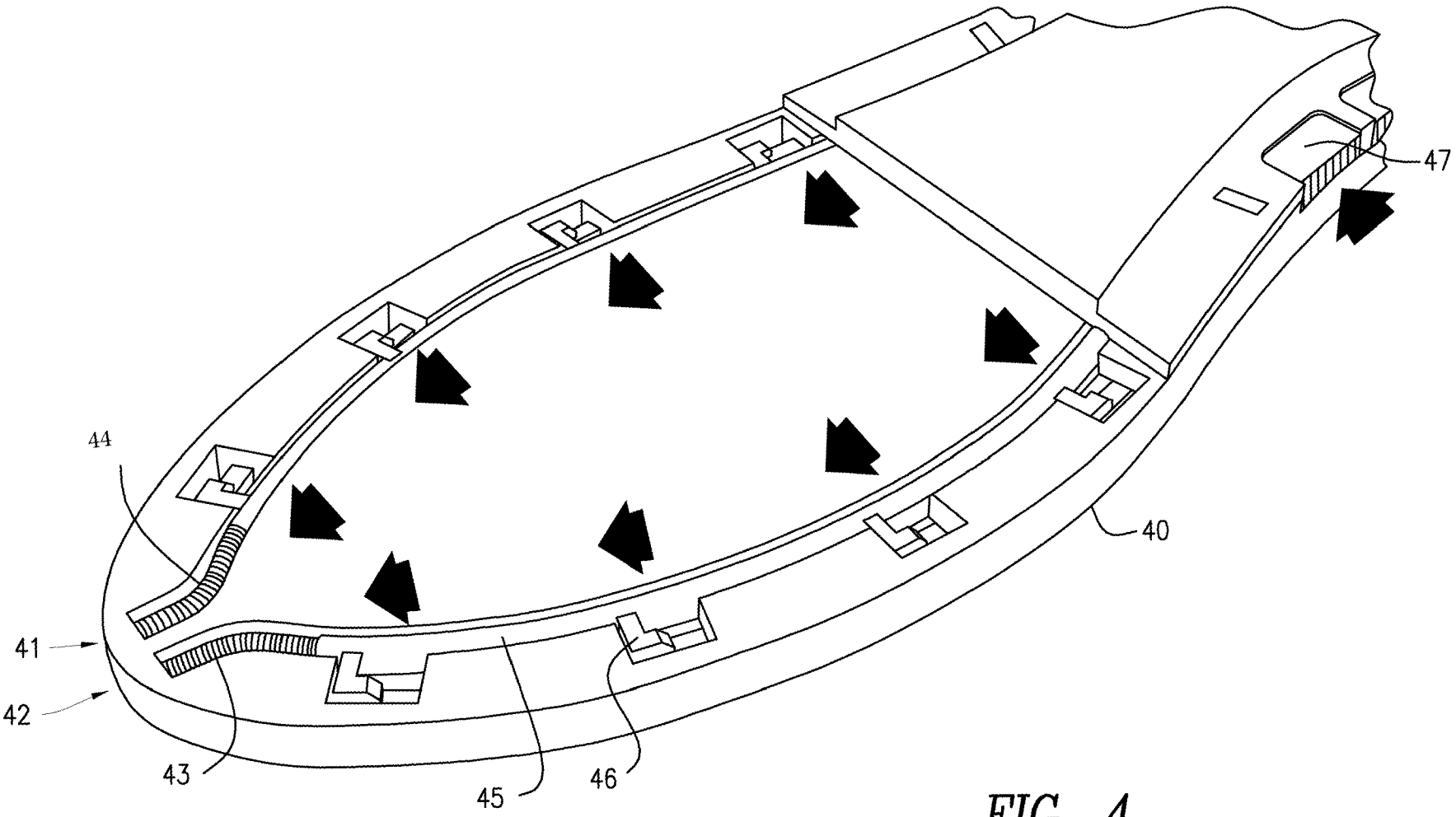
FIG. 4 shows an exemplary embodiment of the spring locking system in the sole of the footwear of the present invention.

FIG. 4 shows an exemplary embodiment of the invention including the spring lock systems. The spring lock systems are displayed in the "released" position. Sole 40 of the footwear includes at least two spring lock systems positioned around the perimeter of the sole 40, for example, one on a left side 43 of sole 40 and a second on a right side 44 of sole 40. Another example of two spring locks includes one spring lock around the perimeter of the front, toe, of the footwear and a second spring lock positioned around the perimeter of the rear, heel, of the footwear. Four spring lock systems may also be used, for example, two spring lock systems positioned generally around the toe 41 of the footwear with one on the right side and one on the left side of the sole. The other two spring lock systems positioned generally around the heel of the footwear also on the right and left side. Together, the four spring lock systems encompass the perimeter of the sole. Each spring lock system includes a spring 43 and a flexible shaft 45 located within sole 40 of the footwear. Majority of the spring is enclosed in a flexible shaft. The spring lock systems 42 also each include locks 46 located in an engagement point that engage with loops on the upper portion of the footwear to secure the footwear in place. The number of locks 46, their location around the perimeter, and the distance between each lock 46 is such that their number, location, and the distance between them provide secure attachment between the upper portion of the footwear and sole 40 while also permitting sufficient flexibility and comfort to allow the footwear to be used as intended. The number, location, and the distance between the locks will also depend in part on the size of the sole (the wearers shoe size as the main measurement; larger shoes sizes will require more locks, smaller shoes sizes will require fewer locks).

Figure 5:
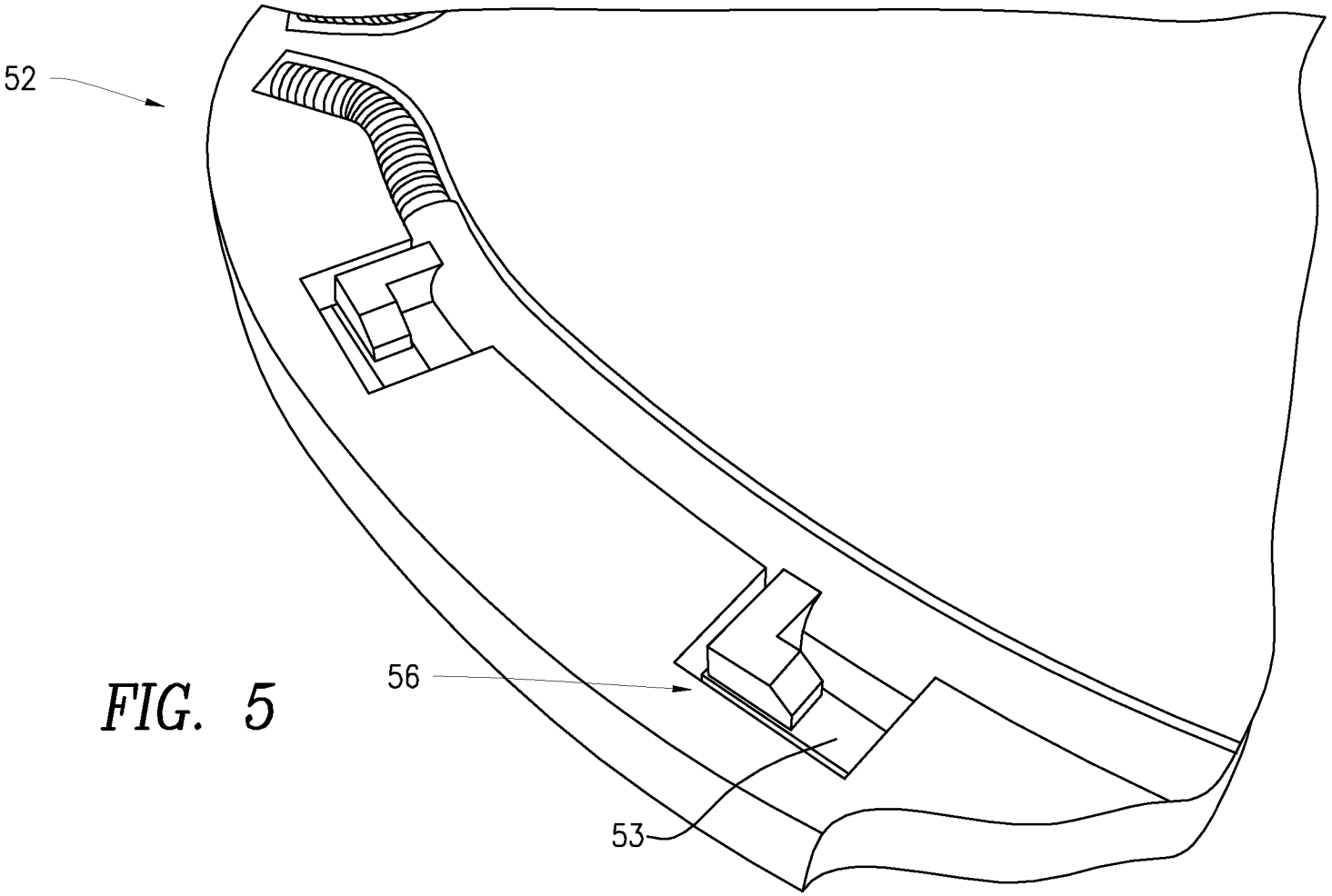
FIG. 5 shows an exemplary embodiment of the spring plate and lock in the sole of the present invention.

FIG. 5 shows spring lock mechanism 52 including spring plate 53. Spring plate 53 keeps the loops attached to upper portion of the footwear securely fastened in lock 56. Spring plate 53 keeps lock 56 in tension.

Figure 6:
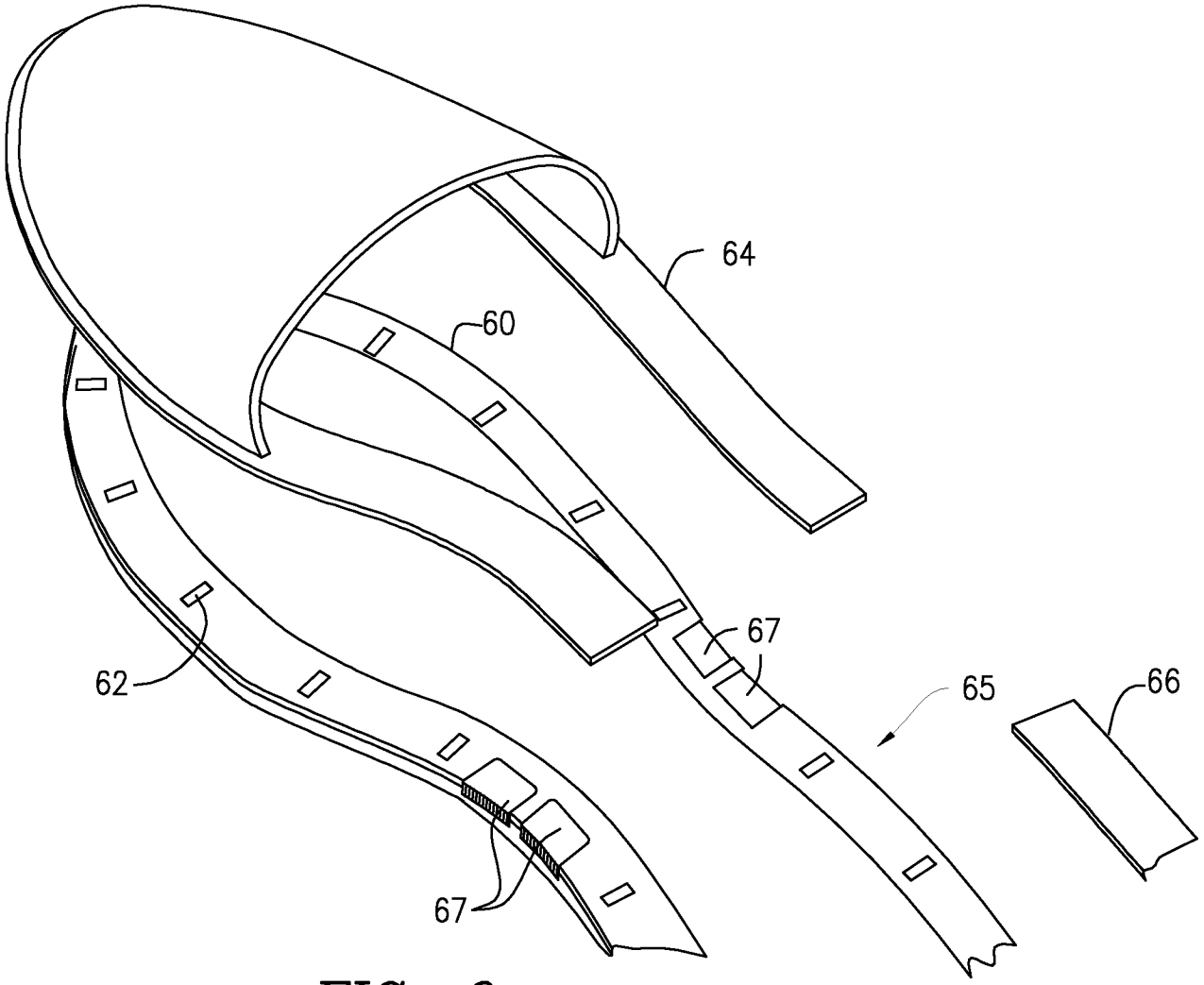
FIG. 6 shows an exemplary embodiment of the upper portion and the sole of the present invention including the buttons for locking and releasing the upper portion.

FIG. 6 shows an exemplary embodiment of the spring lock mechanism engagement points 62 released using buttons 67 on each side of sole 60 in front of the heel 65, at or near the arch or instep arch. One or more buttons may be located on each side of the sole, for example a set of buttons. Each set of buttons include at least two buttons. Each button may be used to release a different section of the spring lock mechanisms, for example, one set of buttons 67 may be used to release front upper portion 64 from sole 60, the right and the left, when 2 spring lock mechanisms are being used. The other set of buttons 67 on the opposite side of the sole may be used to release rear upper portions 66 (right and left) from sole 60. In another example, a button in each set may be used to release a different spring lock mechanism, for example, the front left mechanism, the front right mechanism, the rear left mechanism and the rear right mechanism. Engagement points 62 of the spring lock system are used to position upper portions 64, 66 on sole 60.

Figure 7:
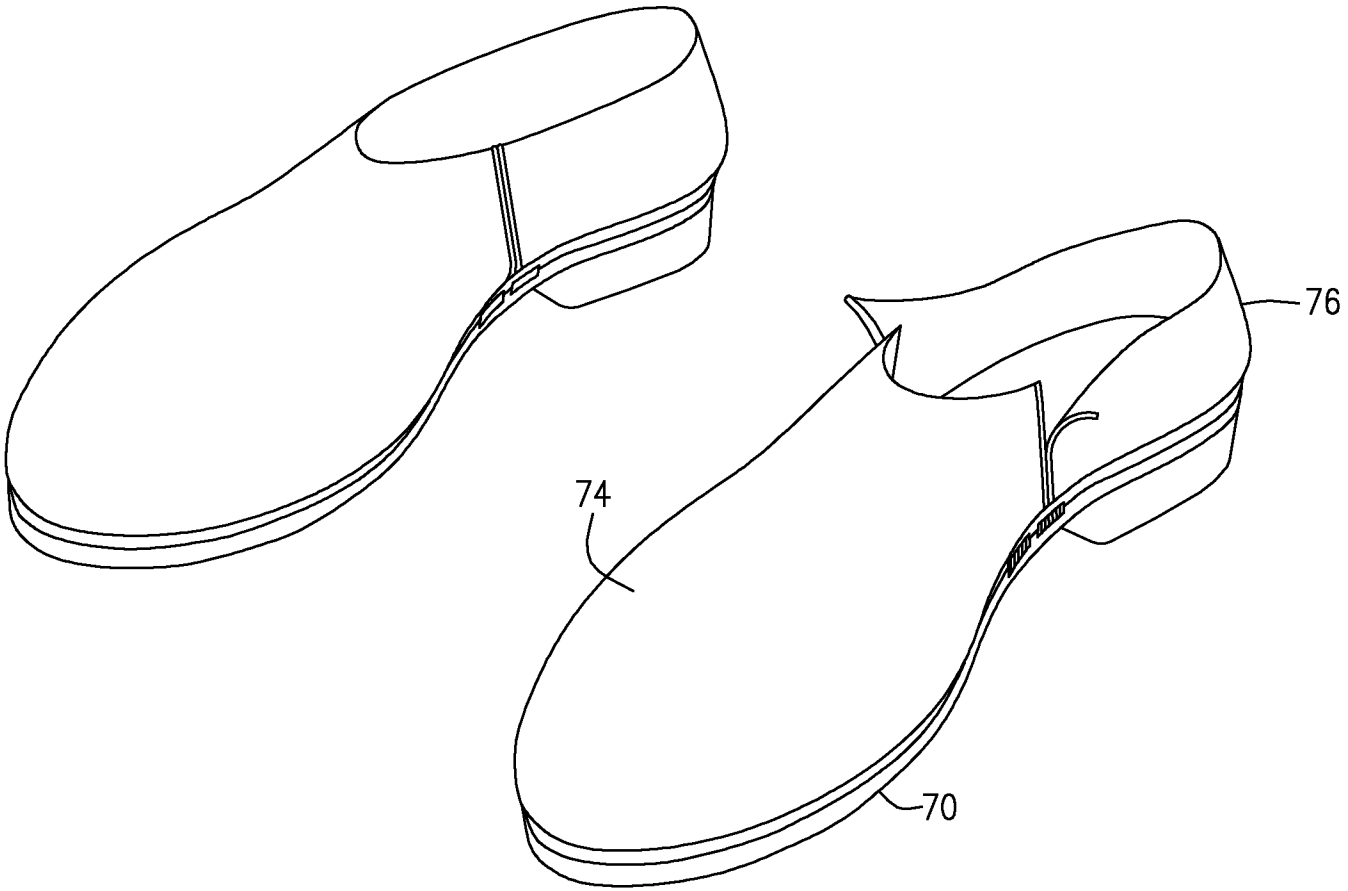
FIG. 7 shows an exemplary embodiment of the upper portion of the footwear being separate sections.

FIG. 7 shows an exemplary embodiment of the upper portion of the footwear comprising separate pieces. Front upper portion 74 and rear upper portion 76 can be separate portions on sole 70, can be joined together through a plastic zipper, metal zipper, Velcro, snap buttons, hooks, or any other suitable and fashionable way to join the uppers 74 and 76.

The present invention also includes a lip made of silicone, rubber, or other waterproof material around the perimeter of, and on the outer portion of, the sole. The lip may be used on footwear of any design (e.g., fully closed or open), but is primarily intended for use with fully closed designs to prevent the entry of water into the footwear. The lip will slightly overlap the upper portion of the footwear when the upper portion is locked in place to the sole. The lip will protrude above the height of the sole by no more than two centimeters.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. An article of footwear, comprising:

one or more interchangeable upper portions, the upper portion including loops on a bottom portion of the upper portion, a sole, the sole having engagement points around a perimeter of the sole, wherein the engagement points in the sole allow the loops to be inserted and/or removed;

at least two spring lock systems, the spring lock systems located in the perimeter of the sole, wherein the spring lock systems include a spring, a flexible shaft, a lock and a spring plate, the lock and the spring plate being located in the engagement points, wherein the loops of the one or more upper portions to the sole engage with the lock and spring plate to secure and/or release the loops in position, and two or more sets of buttons on the sole to release or engage the spring lock system.

2. The article of footwear as recited in claim 1, wherein the spring lock system is manually operated.

3. The article of footwear as recited in claim 1, wherein the one or more upper portions and the sole provides an open toe configuration for the footwear.

4. The article of footwear as recited in claim 1, wherein the one or more upper portions and the sole provide a closed toe configuration for the footwear.

5. The article of footwear as recited in claim 4, wherein the one or more upper portions and the sole provide a boot configuration for the footwear.

6. The article of footwear as recited in claim 1, wherein the loops are made of metal, plastic or another rigid material.

7. The article of footwear as recited in claim 1, wherein when the sets of buttons are pressed, the buttons release the spring lock systems and when the buttons are released, the spring locks protrude to engage and lock the loops of the upper portion.

8. The article of footwear as recited in claim 1, wherein the at least two spring lock systems encompass the perimeter of the sole, a first of the at least two spring lock systems is located on a left side of the sole and a second of the at least two spring lock systems is located on a right side of the sole.

9. The article of footwear as recited in claim 1, further comprising a lip around the sole, wherein when the one or more of the upper portions are attached, the lip covers the meeting point between the one or more upper portion and the sole.

* * * * *